United States Patent [19]

Yamada

[11] Patent Number: 4,570,937

[45] Date of Patent: Feb. 18, 1986

[54] TWO PIECE SOLID GOLF BALL

[75] Inventor: Mikio Yamada, Kobe, Japan

[73] Assignee: Sumitomo Rubber Industries, Ltd., Kobe, Japan

[21] Appl. No.: 531,564

[22] Filed: Sep. 13, 1983

[30] Foreign Application Priority Data

Sep. 13, 1982 [JP] Japan ..... 57-160563

[51] Int. Cl.[4] ..... A63B 37/12

[52] U.S. Cl. ..... 273/220; 273/218

[58] Field of Search ..... 273/218, 219, 220, 230

[56] References Cited

FOREIGN PATENT DOCUMENTS 1177226 1/1970 United Kingdom ..... 273/118

*Primary Examiner*—George J. Marlo

*Attorney, Agent, or Firm*—Armstrong, Nikaido, Marmelstein & Kubovcik

[57] ABSTRACT

A two piece solid golf ball having a high impact resilience and an excellent durability, comprising a solid core and a cover, said solid core having a particular hardness distribution such that the hardnesses measured by a JIS-C hardness tester are from 72 to 78 at the surface, from 77 to 83 at the position "A", 5 mm. apart from the surface, from 72 to 80 at the position "B", 10 mm. apart from the surface, from 67 to 75 at the position "C", 15 mm. apart from the surface, and not more than 75 at the residual center portion.

3 Claims, 1 Drawing Figure

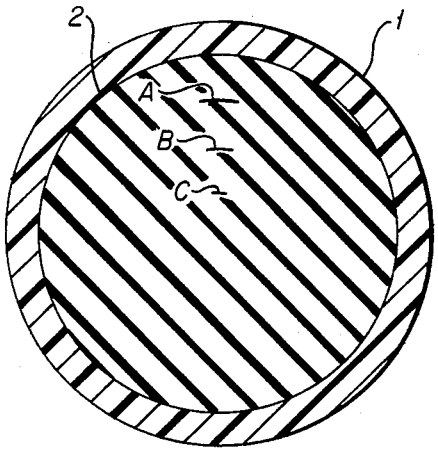
2
1
A
B
C

TWO PIECE SOLID GOLF BALL

BACKGROUND OF THE INVENTION

The present invention relates to a two piece solid golf ball, and more particularly to a two piece solid golf ball having a high impact resilience and an excellent durability.

Wound golf balls which have hitherto been widely employed, have the advantages of being high in impact resilience and of being high in initial velocity upon impact, but have the fatal defect that they are lacking in durability.

In order to improve the durability, two piece solid golf balls consisting of a solid core having a high impact resilience and a cover having an excellent cut resistance have been developed. However, such two piece solid golf balls are also not necessarily satisfactory for the present demands, and accordingly it is desired to further improve the performances of the golf balls.

SUMMARY OF THE INVENTION

In the production of two piece solid golf balls, curing of a core composition has been conventionally carried out by a curing method as generally adopted in curing of a rubber, e.g. a method in which curing is carried out at a constant temperature in the vicinity of about 165° C. for a prescribed period of time, despite that a solid core is relatively thick, namely has a radius of about 18.0 to about 19.5 mm. In that case, the surface portion of the core is cured in somewhat excess, and the center portion is somewhat insufficiently cured. Accordingly, the hardness of the surface portion becomes too high (cured over) and the impact resistance is lowered, thus resulting in lowering of the durability of the golf ball. In case of curing a core composition at a lower temperature for a longer period of time in order to avoid this, the degree of curing of the surface portion becomes inevitably low, because the curing condition is selected so that curing of the center portion is optimum. Therefore, the difference in modulus of elasticity between the core and the cover becomes large, and it causes the impact resilience of the golf ball to lower. The distribution of hardness in the solid core exerts an important influence on the impact resilience and durability of the golf ball. Two piece solid golf balls having a high impact resilience and an excellent durability are obtained by providing a particular hardness distribution to the solid core.

In accordance with the present invention, there is provided a two piece solid golf ball comprising a solid core and a cover for covering the solid core, said solid core having a distribution of hardness such that the hardnesses measured by a JIS-C hardness tester are from 72 to 78 at the surface, from 77 to 83 at the position 5 mm. apart from the surface, from 72 to 80 at the position 10 mm. apart from the surface, from 67 to 75 at the position 15 mm. apart from the surface, and not more than 75 at the residual center portion.

BRIEF DESCRIPTION OF THE DRAWING

The drawing shows a cross section of a two piece solid golf ball according to the present invention.

DETAILED DESCRIPTION

It is preferable that the distribution of hardness of the solid core is such that the hardness progressively increases from the surface to the 5 mm. inner position and then progressively decreases in the direction of the center of the core, namely such that the hardnesses measured by a JIS-C hardness tester are from 72 to 78 at the surface, from 77 to 83 at the position 5 mm. apart from the surface in the direction of the center of the core, from 72 to 80 at the position 10 mm. apart from the surface, from 67 to 75 at the position 15 mm. apart from the surface, and not more than 75 at the residual center portion. Such a hardness distribution can be obtained by stepwise carrying out the curing of a core composition. For instance, in one of the preferable curing methods, curing is carried out stepwise at a temperature of 120° to 140° C. for 3 to 5 minutes, at a temperature of 130° to 160° C. for 5 to 20 minutes and then at a temperature of 140° to 160° C. for 5 to 20 minutes.

The term "JIS-C hardness tester" as used herein means a spring type hardness tester (model C) provided in Japanese Industrial Standards (JIS) K 6301.

Preferable compositions employed for forming a solid core of the golf ball of the invention are, for instance, compositions comprising cis-1,4-butadiene rubber. 20 to 60 parts by weight of an acrylic or methacrylic acid salt, 10 to 60 parts by weight of zinc oxide and 0.5 to 5 parts by weight of a peroxide such as dicumyl peroxide, respectively, per 100 parts by weight of the rubber. The core is prepared by heat pressure molding the composition into a sphere.

As a cover for covering the solid core, there is preferably employed a cover composition comprising an ionomer resin, polyurethane, polyamide or polyacetal as a main component, into which an inorganic filler, e.g. titanium dioxide and zinc oxide, may be incorporated for the purpose of coloring or the like, as occasion demands. The use of ionomer resins, e.g. ionomer resins sold under the trademark "Surlyn" by the E. I. Dupont de Nemours Company, is particularly preferred, since the cut resistance is excellent. Additives such an antioxidants and stabilizers may also be added.

A method for covering the solid core with a cover material is not particularly limited, and known methods are adoptable. Usually, the solid core is covered with two covers previously molded in the form of a hemispherical shell, and it is then pressure molded to fuse two hemispherical shells together and to form dimples, for instance, at about 170° C. for about 2 minutes. A method in which a cover composition is injection molded directly around the solid core is also adoptable.

A cross section at the equator of a two-piece solid golf ball according to the present invention is shown in the drawing. The golf ball consists of a cover 1 and a solid core 2. The solid core is provided with a distribution of hardness by a stepwise curing of the core composition. The hardness, measured by a JIS-C hardness tester, is 72 to 78 at the surface of the core 2, 77 to 83 at the position A 5 mm from the surface, 72 to 80 at the position B 10 mm from the surface, 67 to 75 at the position C 15 mm from the surface and not more than 75 at the residual center portion of the core 2.

The present invention is more specifically described and explained by means of the following Examples, in which all parts are by weight.

It is to be understood that the present invention is not limited to the Examples, and various changes and modifications may be made in the invention without departing from the spirit and scope thereof.

EXAMPLES 1 AND 2 AND COMPARATIVE EXAMPLES 1 to 4

Six kinds of solid cores having a diameter of 37.1 mm. were prepared by curing core compositions shown in Table 1 in a mold (in other words, by heat pressure molding).

TABLE 1

| | Core composition (part) | |
|---|---|---|
| | I | II |
| Cis-1,4-butadiene rubber | 100 | 100 |
| 1,3-Butylene dimethacrylate | 40 | — |
| Zinc dimethacrylate | — | 30 |
| Zinc oxide | 58 | 52 |
| Dicumyl peroxide | 1.5 | 1.5 |

The conditions of the above-mentioned curing (mold temperature set and curing time) and the distribution of hardness of the solid core are shown in Table 2.

Two half shells of a cover formed from a cover composition shown in Table 2 were positioned around each solid core, and subjected to pressure molding in a mold for a golf ball at 170° C. for 2 minutes to give a two piece solid golf ball having a diameter of 41.3 mm.

The properties of the obtained golf balls are shown in Table 2.

In Table 2, the initial velocity of the golf ball was measured with respect to a ball struck with a wood No. 1 golf club (driver) at a head speed of 45 m./sec. by a swing machine (swing robot made by True Temper Co., Ltd.).

Also, the durability index shows an index of the number of impacts till breaking of a golf ball to that of the golf ball of Example 1 regarded as 100. The number of impacts till breaking was measured by striking the ball at a head speed of 45 m./sec. by the above-mentioned swing machine.

TABLE 2

| | Ex. 1 | Com. Ex. 1 | Com. Ex. 2 | Ex. 2 | Com. Ex. 3 | Com. Ex. 4 |
|---|---|---|---|---|---|---|
| Core composition | I | I | I | II | II | II |
| Mold temperature and curing time | 120° C., 5 min.; 135° C., 15 min.; 145° C., 10 min. | 165° C., 26 min. | 140° C., 38 min. | 120° C., 5 min.; 135° C., 5 min.; 145° C., 15 min. | 165° C., 25 min. | 140° C., 40 min. |
| Hardness distribution surface | 76 | 82 | 68 | 73 | 83 | 65 |
| 5 mm. inside from the surface | 80 | 76 | 70 | 79 | 75 | 70 |
| 10 mm. inside from the surface | 76 | 73 | 75 | 77 | 73 | 75 |
| 15 mm. inside from the surface | 73 | 70 | 75 | 73 | 70 | 74 |
| center portion | 70 | 65 | 71 | 71 | 65 | 73 |
| Cover composition (part) | | | | | | |
| Ionomer resin* | 100 | 100 | 100 | 100 | 100 | 100 |
| Titanium dioxide | 2 | 2 | 2 | 2 | 2 | 2 |
| Properties | | | | | | |
| Weight of ball (g.) | 45.2 | 45.4 | 45.5 | 45.1 | 45.0 | 45.3 |
| Hardness of ball | proper | proper | proper | proper | proper | proper |
| Initial velocity (m./sec.) | 65.6 | 65.4 | 64.8 | 66.7 | 66.6 | 66.0 |
| Durability index | 100 | 23 | 98 | 108 | 31 | 110 |

*Ionomer resin sold under the trademark "Surlyn 1707" by E. I. DuPont de Nemours Co.

As shown in Table 2, the golf balls of Examples 1 and 2 in accordance with the present invention have a high initial velocity and an excellent durability.

In contrast with this, the golf balls of Comparative Examples 1 and 3 are very poor in durability and are not suited for practical use. The reason is considered to be that since the curing is carried out at a high constant temperature in consideration of curing of the core at large, the surface portion is cured in excess and the center portion is cured in a low degree, thus the hardness of the surface portion becomes too high.

The golf balls of Comparative Examples 2 and 4 have a durability of the same degree as that of the balls of Examples 1 and 2, but are lower in initial velocity. The reason is considered to be that since curing at a low temperature for a long time is adopted in consideration of optimum curing of the core center portion, the degree of curing of the surface poriton is low, and consequently the difference in modulus of elasticity between the core surface portion and the cover having a high modulus of elasticity becomes large and a gap in transmission of the force of compressive resilience at the time of striking the ball is produced at the boundary between them, whereby the impact resilience of the ball is impaired. Also, the production of the golf balls of Comparative Examples 2 and 4 is uneconomical, because the curing requires a long period of time.

EXAMPLES 3 AND COMPARATIVE EXAMPLES 5 AND 6

Solid cores having a diameter of 38.2 mm. for 1.68 inch large-sized golf balls were prepared by curing a core composition shown in Table 3 in a mold.

TABLE 3

| | Core composition (part) |
|---|---|
| | III |
| Cis-1,4-butadiene rubber | 100 |
| Zinc dimethacrylate | 33 |
| Zinc oxide | 18 |
| Dicumyl peroxide | 1.0 |

The conditions of the above-mentioned curing (mold temperature set and curing time) and the distribution of hardness of the solid core are shown in Table 4.

A cover composition shown in Table 4 was injection molded directly around each solid core to give two piece solid golf balls having a diameter of 42.8 mm.

The properties of the obtained golf balls are shown in Table 4.

In Table 4, the durability index shows an index of the number of impacts till breaking of a golf ball to that of the golf ball of Example 3 regarded as 100.

TABLE 4

| | Ex. 3 | Com. Ex. 5 | Com. Ex. 6 |
|---|---|---|---|
| Core composition | III | III | III |
| Mold temperature and curing time | 120° C., 5 min.; 155° C., 5 min.; 150° C., 20 min. | 170° C., 20 min. | 140° C., 30 min. |
| Hardness distribution | | | |
| surface | 76 | 82 | 35 |
| 5 mm. inside from the surface | 81 | 78 | 38 |
| 10 mm. inside from the surface | 79 | 75 | 45 |
| 15 mm. inside from the surface | 75 | 71 | 63 |
| center portion | 74 | 68 | 71 |
| Cover composition (part) | | | |
| Ionomer resin* | 100 | 100 | 100 |
| Titanium dioxide | 2 | 2 | 2 |
| Properties | | | |
| Weight of ball (g.) | 45.3 | 45.3 | 45.1 |
| Hardness of ball | proper | proper | soft |
| Initial velocity (m./sec.) | 68.9 | 68.3 | 64.9 |
| Durability index | 100 | 41 | 33 |

*Ionomer resin sold under the trademark "Surlyn 1707" by E. I. DuPont de Nemours Co.

As shown in Table 4, the golf ball of Example 3 in accordance with the present invention has a high initial velocity and an excellent durability as compared with the golf balls of the Comparative Examples.

In addition to the ingredients used in the Examples, other ingredients can be used in the Examples as set forth in the specification to obtain substantially the same results.

What is claimed is:

1. A two piece solid golf ball comprising a solid core and a cover for covering the solid core, said solid core having a distribution of hardness such that the hardnesses measured by a JIS-C hardness tester are from 72 to 78 at the surface, from 77 to 83 at the position 5 mm. apart from the surface, from 72 to 80 at the position 10 mm. apart from the surface, from 67 to 75 at the position 15 mm. apart from the surface, and not more than 75 at the residual center portion.

2. The golf ball of claim 1, wherein said cover comprises an ionomer resin.

3. The golf ball of claim 1, wherein said solid core is made of a rubber composition comprising cis-1,4-butadiene rubber.

* * * * *